United States Patent [19]

Hsu et al.

[11] Patent Number: 4,692,237

[45] Date of Patent: Sep. 8, 1987

[54] PROCESS FOR THE REMOVAL OF SOLIDS FROM AN OIL

[75] Inventors: Edward C. Hsu, Bridgewater, N.J.; Philip Merchant, Jr., Houston, Tex.; Dean L. Smith, Jr., Mountainside, N.J.; Kevin P. Kelly, Houston; Sylvia M. Lacy, Pearland, both of Tex.

[73] Assignee: Exxon Chemical Patents Inc., Linden, N.J.

[21] Appl. No.: 718,134

[22] Filed: Apr. 1, 1985

[51] Int. Cl.[4] ..... C10G 29/20; C10G 33/04

[52] U.S. Cl. ..... 208/177; 208/188; 210/728; 210/729; 210/734

[58] Field of Search ..... 208/177, 188; 210/729, 210/734, 735, 736, 728, 708; 252/358, 8.55 B, 8.3

[56] References Cited

U.S. PATENT DOCUMENTS

| | | | |
|---|---|---|---|
| 2,885,357 | 5/1959 | Archibald et al. | 210/735 |
| 3,503,946 | 3/1970 | Scanley et al. | 210/734 |
| 3,686,109 | 8/1972 | Aldrich et al. | 210/728 |
| 3,976,552 | 8/1976 | Fanta et al. | 525/54.31 |
| 4,069,152 | 1/1978 | Specken | 210/728 |
| 4,102,827 | 7/1978 | Rembaum et al. | 210/734 |
| 4,326,948 | 4/1982 | Zang | 208/177 |
| 4,382,852 | 5/1983 | McCoy et al. | 208/188 |
| 4,417,976 | 11/1983 | Sander et al. | 208/188 |
| 4,434,850 | 3/1984 | McCoy | 208/188 |
| 4,457,371 | 7/1984 | McCoy et al. | 208/188 |
| 4,466,805 | 8/1984 | Ronden | 208/188 |
| 4,472,284 | 9/1984 | Bolhofner | 210/708 |
| 4,536,294 | 8/1985 | Guillet et al. | 210/734 |
| 4,537,701 | 8/1985 | Oppenlaender et al. | 210/708 |
| 4,539,100 | 9/1985 | Ronden | 210/708 |
| 4,541,918 | 9/1985 | Stapp | 208/251 R |
| 4,569,768 | 2/1986 | McKinley | 210/734 |
| 4,582,627 | 4/1986 | Carlsson | 210/734 |
| 4,587,108 | 5/1986 | MacDonald | 210/734 |
| 4,599,390 | 7/1986 | Fan et al. | 210/734 |

*Primary Examiner*—Andrew H. Metz
*Assistant Examiner*—Anthony McFarlane
*Attorney, Agent, or Firm*—R. L. Graham

[57] ABSTRACT

A process for removing suspended solids, particularly difficultly filterable inorganic solids, from an oil obtained as a refinery process fraction from steam and catalytic cracking units, shale oil retorting process fraction, or from coal conversion processes by adding to the oil an agglomerating agent which is a polyelectrolyte, usefully a water-in-oil emulsion of a water-soluble polymer whereby said solids are clustered together into readily separable agglomerates.

6 Claims, No Drawings

PROCESS FOR THE REMOVAL OF SOLIDS FROM AN OIL

FIELD OF THE INVENTION

This invention is concerned generally with the removal of suspended solids from an oil. More particularly it relates to a process for producing a solids-reduced hydrocarbon oil in which suspended solids in the oil are agglomerated by adding to the oil a solids-agglomerating agent comprising a polyelectrolyte and separating the agglomerated solids from the oil.

BACKGROUND OF THE INVENTION

A number of processes in petroleum production and refining, oil shale retorting, coal conversion and the chemicals industry produce as products liquid hydrocarbons containing insoluble solid particles oftentimes in the form of finely divided suspended inorganic solids.

Among the processes which produce liquid hydrocarbons containing appreciable amounts of finely divided suspended solids are steam cracking, catalytic cracking, coal gasification, coke production, and liquification of coal. Steam cracking produces a steam cracking tar which contains insoluble particles of coke generally at a level of 0.001 to 6.0% with the remainder being useful heavy liquid hydrocarbons. Catalytic cracking produces bottoms which contain catalyst fines generally at a level of 0.1 to 5 wt.% with the remainder being useful heavy liquid hydrocarbons. Oil shale retorting typically produces an oil containing 0.1 to 15 weight percent spent shale fines. Liquification of coal, such as by the donor solvent technique as described in U.S. Pat. Nos. 4,085,031; 4,253,937; 4,048,054 and 4,045,328, produces a solvent-coal slurry containing insoluble particles. Other liquids from coal are produced in its conversion processes by, for example, in its gasification, coke preparation and other processes involving the pyrolysis of coal. These liquid hydrocarbon streams contain insoluble particles which are desirably removed or reduced in level to allow for their use as a fuel oil or as a feedstock for producing other products.

These liquid hydrocarbon streams oftentimes are routed to a settling tank wherein the solid particles (catalyst fines, shale fines, coke, inorganic matter) are allowed to gravity settle over an extended period of time whereby an upper layer of substantially particle-free liquid hydrocarbons can be decanted off for product use. Settling of the particles may also be provided for in intermediate or shipping tanks. Unfortunately, gravity settling is too slow for the refinery, shale oil retorting, coal conversion and chemical processes now in use.

Improved techniques which are in use include electrofiltration, filtration and centrifugal separation. The latter two approaches appear to have a low capacity or throughput and high capital cost. Electrofiltration was handicapped by lack of a regenerable filter media which is stated to have been overcome by the use of hard, smooth spherical glass beads as taught in U.S. Pat. Nos. 3,799,855 and 3,799,856. However, electrofiltration still cannot handle oils having high electrical conductivity and is not suitable with high levels of solids. Unfortunately, these techniques are further limited since the typical oil-suspendible solids have average diameters of size below about 100 microns (commonly described in the art as difficultly filterable solids) which size makes satisfactory separation by mechanical separation techniques, including filtration, centrifugation and settling, difficult to impossible.

Chemical treatments for oil containing suspended solids have been proposed in the art but, in general, each method suffers from disadvantage as seen from the prior art discussion of U.S. Pat. No. 4,094,770 wherein the patentee has taught a process for separating suspended unfilterable particulate solids from an oil by agglomerating the solids by means of an agglomerating agent comprising a mixture of acetone and 2-butanone.

In U.S. Pat. No. 4,029,567 an agglomerating agent, especially ethanolamine is used to help separate the mineral solids and undissolved coal particles from a solution of coal liquification products.

Gravity settling can also be enhanced by the presence of a surface-active agent as taught in U.S. Pat. No. 2,952,620 wherein solid particles of a silica-alumina cracking catalyst suspended in a heavy gas oil was separated from the oil by treating the suspension with an aqueous solution of a nonionic surface-active agent, e.g., a condensation product of diisobutyl phenol and 9–10 moles of ethylene oxide.

Gravity settling can be induced by use of a settling vessel in which the hydrocarbon oil containing the solids is subjected to a temperature gradient (see U.S. Pat. No. 4,048,063).

The dedusting of solids-containing hydrocarbon oils such as these derived from oil shale is accomplished by the use of various surface-active agents (see U.S. Pat. No. 4,407,707).

Japanese Published Patent Application Showa 53-34806 of 1978 regenerates used, iron contaminated lubricating oil by the addition of water-soluble macromolecular polymers as water-in-oil emulsions to coagulate the iron whereby it becomes suitable for mechanical removal.

The use of gravity settling additives and techniques have enhanced the settling rate whereby gravity settling became a feasible method for removal of suspended solids requiring little additional capital investment, a mechanically simple operation and readily modified by change of the additive.

It is the object of this invention to enhance the gravity settling rate of suspended solids from hydrocarbon oils by use of an improved agglomeration aid alone or in combination with other additives.

SUMMARY OF THE INVENTION

It has been discovered that hydrocarbon oils from petroleum and coal conversion processes, for example hydrocarbon oils boiling in the range of about 60° C. to 600° C. can be readily reduced to an inorganic solids content of less than 500 weight parts per million (WPPM) of filterable solids when admixed with from 25 to 1000, preferably 50 to 250 ppm of a polyelectrolyte, preferably a water-soluble polyelectrolyte, of 1,000 to 25 million molecular weight ($\overline{M}w$) at a temperature of from 35° to 210° C. and allowed to gravity settle for from 0.3 to 10 days.

In accordance with the object of this invention there is provided a process for reducing the particulate solids content of a hydrocarbon oil fraction comprising:

providing a hydrocarbon oil fraction having dispersed solid particulates, oftentimes greater than 0.2 weight percent.

treating said fraction with at least 10 weight parts per million of a macromolecular polyelectrolyte, preferably as a water-in-oil emulsion; and;

recovering a hydrocarbon oil portion having a reduced content of dispersed particulates.

The agglomeration aid is of the class of macromolecular polyelectrolytes generally of 1,000 to 25 million, preferably 20,000 to 15 million, in molecular weight and preferably of a combined water-polyelectrolyte aggregate size of 0.5 to 50 microns such as would be exhibited by water-in-oil emulsions of water-soluble vinyl addition polymers of weight average molecular weight ($\overline{M}w$) ranging from 10,000 to 25,000,000.

Preferred are cationic polyamines such as a Mannich amine polymer or a partially quaternized tertiary amine polymer and the homopolymers and copolymers of acrylamide.

DETAILED DESCRIPTION OF THE INVENTION

Within the steam cracking reaction or the catalytic cracking reactor, the liquid hydrocarbon feedstock is subjected to processing conditions of elevated temperature and sometimes elevated pressure to accomplish the desired cracking. The resultant effluent of the reactor is then fractionated into the desired fractions of gases, light liquid hydrocarbons and heavy liquid hydrocarbons, with the heaviest and highest boiling fraction being the steam cracker tar or the catalytic cracker bottoms which contain the insoluble organic and/or inorganic particles. The coal liquification process involves contacting particulate coal with a hydrogen (e.g. a hydrogen donor solvent) under liquification conditions producing a hydrocarbon stream containing insoluble particles. The hydrocarbon stream can be fractionated to produce gases, light liquid hydrocarbons and heavy liquid hydrocarbons with the heaviest fraction being the bottoms containing the particles. Other liquids from coal are produced by coal conversion process utilizing the pyrolysis of coal.

The gasification of low-BTU coal to supply fuel gas for boilers, kilns and process furnaces was widespread until low cost natural gas became available. The natural gas curtailments in the early 1970s along with the rapid rise in natural gas prices have reawakened interest in industrial coal gasification to provide fuel gas for kiln operations, heat treating furnaces, boilers and industrial heating. The gasification process yields a hot raw producer gas which upon quenching yields varying amounts of coal tar. Since the coal tar has wide industrial applications both for tar-based chemical and pharmaceutical products and for fuels, it is highly desirable to reduce the inorganic ash content of these tars. Similarly in the production of coke, the gas derived from the carbonization of the coal into coke can contain significant amounts of coal tar which is recovered and similarly processed.

Thus, this invention broadly treats any liquid hydrocarbon stream containing insoluble solids or particles, particularly fine inorganic and/or organic solids and liquid hydrocarbons, to remove or substantially reduce the solids content of the hydrocarbon oil and is particularly applicable to oils containing finely divided suspended solids.

Finely divided oil-suspended solids, in general, are effectively removed from the oil by the process of the invention. Those common properties which engender oil suspendability of these particles, for example particle size, density, charge and the like, are also believed to render them susceptible to effective agglomeration and removal by the present process. Representative solids include mineral ash-forming impurities, coal coke, carbonaceous solids, catalyst and spent shale fines, natural and synthetic mineral oxides, organic and inorganic salts mixtures thereof and the like in particulate form and for the unfilterable solids sized in the average diameter range below about 100 microns, especially below about 60 microns.

Representative suspended-solids-containing oils suitable for use herein include shale oil, coal liquefaction oils as from extraction, hydrogenation, thermal treatment and combinations thereof, coal tars from coke manufacture, tar sand oils, petroleum refinery decant oils such as fractionator bottom oils from a fluid catalytic cracking process bottoms, fractions of said oils, resids, mixtures thereof, and the like oils. Characteristically, these oils have little condensed water so that the oils treated by this invention broadly have less than about 10% water; specifically, less than about 5% and preferably, less than about 3% based on the weight of the oil.

These hydrocarbon oils are most effectively treated by the invention when it is a fraction boiling in the range of 60° C. to 600° C., preferably 200° C. to 550° C., with a total insoluble solids content greater than about 1,000 weight parts per million (WPPM), e.g. from 1,000 to 50,000 WPPM, more normally an insoluble solids content in the range of 2,000 to 10,000 WPPM.

THE AGGLOMERATION AID

A prime feature of the present process is the discovery of a unique solids-agglomerating agent which operates in a hydrocarbon oil containing little to no condensed water. A solids-agglomerating agent, to be useful and effective in this service, must promote essentially complete removal of solids from an oil and at the same time must leave the oil virtually intact.

It has been discovered that a macromolecular polyelectrolyte such as a cationic polyamine polymer, when used in admixture with the solids containing hydrocarbon oil in amounts ranging from 10 to 1,000, preferably 25 to 250 WPPM, based on the weight of said oil markedly enhances the gravity settling of said solids so that in from 0.3 to 10 days the solids content of said oil is reduced to less than about 500 WPPM.

Polyelectrolytes as used herein refer to a macromolecular polymer which contain polyions or polyionic functionalities together with their counterions and are generally referred to as water-soluble, although some are water-dispersible (colloidal). The polyelectrolytes have molecular weights ranging from 1,000 to 25 million with those having ($\overline{M}w$)'s in excess of 0.5 million preferred.

For use in this invention, the polyelectrolyte may be either cationic or anionic and, in some instances, the ionic charges are sufficiently slight so that the polymers may be considered as nonionic. For example, polymers and copolymers of allyl, diallyl amines, or dimethylaminoethylmethacrylate are cationic. Polymers such as polyvinyl alcohol are nonionic, and polymers such as polyacrylic acid or polystyrene sulfonates are anionic. All of these polymers are considered useful polyelectrolytes and may be used in the practice of the invention.

The molecular weight of the polyelectrolytes described above may vary over a wide range, e.g., 1,000–25,000,000, although it is preferred to use nitrogen containing (such as acrylamide) polymers whose molecular weights are in excess of 1,000,000. These polyelectrolytes are well known and generally available as articles of commerce. Thus, those polyelectrolytes which have utility in the process of this invention include:

(a) cationic types such as:
- polymerized esters and amides of acrylic or methacrylic acid, that contain pendant cationic functionalities;
- quaternized or partially quaternized Mannich amines; polymers of mono or dialkyl diallyl ammonium salts, or of substituted analogs thereof, or their copolymers with nonionic monomers such as acrylamide;
- quaternized polyalkylene polyamines;
- dialkylamine halohydrin copolymers; and,
- dialkylamine polymethylenedihalide copolymers (a.k.a. ionenes)

(b) nonionic types such as:
- acrylamide polymers;
- polymers of glycol esters of acrylic or methacrylic acid;
- polyoxyethylene, polyoxyalkylenes, or copolymers thereof;
- polyvinylalcohol, or oxyalkylates thereof;
- polyalkylene polyamines, such as tetraethylene pentamine;
- polyoxyalkylated polyamines;
- polysaccharides, celluloses, or chemical modifications thereof, such as carboxymethylates or hydroxyethylates; Mannich amine condensation polymers; melamine formaldehyde condensation polymers; and, (c) anionic types such as:
- partially hydrolyzed polyacrylamide;
- polyacrylic or polymethacrylic acid; and
- sulfonated polystyrene, sulfonated polyalkylstyrene, or copolymers thereof (with these anionic type polymers, the counter ion may be sodium, potassium, calcium, magnesium, ammonium, etc. and their mixtures); and, (d) polyampholytes and polybetaines.

One class of preferred polyelectrolytes are the water-soluble vinyl addition polymers which are well known in the art, widely described in the literature, and generally commercially available as water-in-oil emulsions. The emulsion type polymers most commonly used in industrial applications are acrylamide polymers which include polyacrylamide and its water-soluble copolymeric derivatives such as, for instance, acrylamide-acrylic acid, and acrylamide-acrylic acid salt copolymers which contain from about 95-5% by weight of acrylamide. Also useful are copolymers of acrylamide with other vinyl monomers such as maleic anhydride, acrylonitrile, styrene and the like. Other water-soluble vinyl polymers are described in detail in the following U.S. Pat. Nos.: 3,418,237, 3,259,570 and 3,171,805. These polymers may be produced by any known method of conducting polymerization reactions. Thus, solution, suspension or emulsion polymerization techniques may be used. The emulsion polymerization generally produces polymers or gums having concentrations within the range of 0.1 to 20% by weight. The aqueous solutions of polymers or gums have a solution concentration of 0.2–2.0% by weight.

The water-in-oil emulsions generally contain oil to water weight range of 5:1 to 1:10 with preferred emulsions being prepared in the ratio of 2:1 to 1:2. The aggregate polymer-water gel-like particle in the water-in-oil emulsion ranges from 0.5 to 50 microns in diameter.

Another preferred representative of this class are partially quaternized amine polymers consisting of complex structures of 1°, 2° and 3° amines, and optionally, epichlorohydrins, and having a ($\overline{M}w$) of from 50,000 to 500,000 and high charge density such as Jayfloc® 871 sold by Exxon Chemical Americas of Houston, Texas.

Another class of particularly useful polyelectrolytes are the water soluble Mannich amine polymers of the general formula

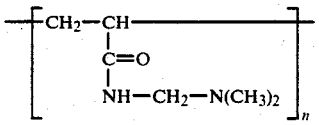

having a ($\overline{M}w$) ranging from 2 to 6 million and high cationic charge density of which a commercial representative is Jayfloc® 854 sold by Exxon Chemical Americas of Houston, Texas.

In the event that the solids-containing hydrocarbon contains from 0.05 to 50 weight percent or greater of a water, it is useful to supplement the agglomeration aid with up to 3 weight percent, of water shedding agent based on the weight of the hydrocarbon oil. Since the water may provoke foaming, silicone defoamants may be also added as well as other nonionic and anionic surfactants. All $\overline{M}w$ given herein are weight average molecular weights are determined by gel permeation chromatography or light scattering as appropriate.

AGGLOMERATION CONDITIONS

Agglomeration conditions for use in the process of the invention will vary depending upon such process factors as the type and solids content of the hydrocarbon oil, the size distribution and for source of the solids and the properties of the oil being processed. In general, the most satisfactory process temperature will range from 35° C. to 350° C., preferably from 50° C. to 225° C. and optimally from 75° C. to 210° C. The system pressure must be adequate to prevent the boiling of the hydrocarbon and any contained water. In general the process residence time required to reach the desired ash level of less than 0.05 wt percent will range broadly from 0.3 to 10, more usually 2 to 5, days.

The agglomeration aid and, if desired, the supplemental additives such as a water deshedding aid are introduced into the hydrocarbon oil stream to be treated prior to or at the point at which said stream is introduced into the top of the settling tank. The product of the process is withdrawn from a point intermediate (on the side), while the solids settle by gravity to the bottom of the tank. The flow rates and unit sizings in the process system are adjusted to provide the desired residence time in the settling tank. The settled solids in the settling tank are withdrawn generally as a sludge for direct disposal or further treatment to recover additional hydrocarbon oil.

The following examples are provided to illustrate the embodiments of the invention and are not intended to limit it in any way.

EXAMPLES 1-3

In each of these, hydrocarbon oil bottom fractions having suspended solids with the following general physical characteristics, were used:

TABLE I

| Physical characteristics | |
|---|---|
| Viscosity cst at 99° C. | 8-10 |
| Ash content, (wt %) | 0.01-0.02 |
| Coking value (wt %) | 6.5-7.2 |
| Asphaltene (n-heptane insolubles), % | 0.5-1.5 |
| Toluene insolubles (0.35), % | 0.1-0.2 |
| Number average mol. wt. | 250-300 |
| Filterable solids (WPPM) | 1,000-50,000 |

The hydrocarbon oil bottom fraction obtained from the refinery and having a boiling range of from 200° C. to 500° C. was charged into a kilogram glass reactor which was electrically heated and equipped with a mechanical agitator. The 200 ml charge of oil was pretreated by heating to 80° C. prior to admixture with a blend containing the indicated agglomeration aid at a blend treat rate of 500 ppm for the oils from Refineries Nos. 1-3 and at both 100 and 200 ppm for the oil from Refinery No. 4. The treated charge was allowed to agitate for 2 minutes and then settle for 72 hours while holding the temperature at 79° C. Thereafter 50 ml was drawn off from the upper region of the reactor and subjected to filtration to determine the filterable solids in weight parts per million (WPPM) according to the following technique.

The 50 ml sample is weighed, as is the filter paper (0.8 microns pore size) used for the test. The sample is preheated to 70°-80° C., then mixed with 150 to 200 ml of hot xylene (heated above 55° C.) and the admixture poured into the vacuum filter. The container and filter paper are fully rinsed with hot xylene and thereafter with heptane. The now fully rinsed paper is dried at 82° C. for 30 minutes and then placed in a desiccator for 30 minutes. The weight of the solids found on the filter paper provides the means for measuring the weight parts per million (WPPM) of filterable solids of the original sample.

The samples treated according to the process of this invention are set forth in Table II with nonenhanced, i.e. untreated, samples in WPPM shown for reference points.

TABLE II

| Example | Additive | Treat Rate (parts per million) | Solids WPPM (agv. 2 runs) |
|---|---|---|---|
| 1 | None | None | 1,045 |
| 2 | Jayfloc ® 854 | 100 | 633 |
| 3 | Jayfloc ® 871 | 100 | 806 |

EXAMPLES 4-14

Various samples of hydrocarbon oils were treated according to the process of the invention. Batch settling tests were carried out to quantify the discovered effectiveness of polyelectrolyte emulsions in flocculating, and thus enhancing the removal of mineral solids from oils. The polyelectrolyte emulsions used were commercially available polyacrylamide based emulsions. The tests were conducted by simple hand mixing of the polyelectrolyte emulsion into the solids-containing hydrocarbon contained in a glass vessel of about 20 ml capacity and carried out at ambient temperatures. No water was added other than that contained in the emulsion. The clarification rate was used as a measure of the effectiveness of the emulsion in flocculating and thus removing the solids. A higher initial clarification rate indicates more effective separation. The reported clarification rate was determined by visual observation of the descending interface between the clarified upper oil phase and lower phase containing agglomerated solids. The results of these tests are set forth in Table III.

TABLE III

Flocculation of Mineral Suspensions in Oil With Polyacrylamide-in-water-in-oil Emulsions

| Example | Suspension | Ionic Nature Additive | Treat Rate (parts per Million) | Initial Clarification Rate (mm/sec) |
|---|---|---|---|---|
| 4 | A | None | 0 | 0.4 (no flocculation) |
| 5 | A | Slightly cationic[1] | 2350 | 0.66 |
| 6 | A | Nonionic[2] | 2350 | 0.66 |
| 7 | A | Slightly anionic[3] | 2350 | 1.60 |
| 8 | A | Slightly anionic[3] | 4700 | 2.00 |
| 9 | B | None | 0 | 0.42 (no flocculation) |
| 10 | B | Anionic[4] | 2350 | 0.83 |
| 11 | B | Slightly anionic[5] | 2350 | 1.05 |
| 12 | B | Nonionic[6] | 2350 | 1.25 |
| 13 | C | None | 0 | 0.71 (no flocculation) |
| 14 | C | Slightly Anionic[3] | 2350 | 2.00 |

Description of Suspension:

A: 4 wt % oil shale dust in simulated shale naphtha (12% toluene/80% heptane), shale dust from Lurgi process retorting of Rundle Kerosene Creek oil shale, 4.4 micron mean particle size, 1.4 g/cm$^3$ particle density.

B: 4 wt % oil shale dust in heptane, same dust as A.

C: 5.3 wt % catalytic cracking catalyst fines in heptane, 6.6 micron mean particle size, 1.6 g/cm$^3$ particle density.

[1]Commercially available as Nalcolyte 7129 from Nalco Chemical of Oak Brook Illinois.

[2]Commercially available as Nalcolyte 7181 from Nalco Chemical of Oak Brook Illinois.

[3]Commercially available as Nalcolyte 7182 from Nalco Chemical of Oak-Brook Illinois.

[4]Commercially available as Superfloc 1202 from American Cyanamid of Wayne, New Jersey.

[5]Commercially available as Superfloc 1201 from American Cyanamid of Wayne, New Jersey.

[6]Commercially available as Superfloc 1128 from American Cyanamid of Wayne, New Jersey.

What is claimed is:

1. A process for reducing the particulate solids content of a hydrocarbon oil fraction comprising:

providing a hydrocarbon oil fraction containing less than 10 wt % water;

treating said hydrocarbon oil fraction with an agglomeration aid introduced as a water-in-oil emulsion wherein the water to oil ranges from 5:1 and 1:10 and wherein the resulting mixture contains from 10 to 1000 weight parts per million (WPPM) of said aid based on the total weight of said mixture, said agglomeration aid being a water soluble polyelectrolyte of Mw ranging from 0.5 million to 25,000,000 and forming a polymer-water particles suspended in said oil, said particle agglomerating solids contacted therewith;

removing substantial portions of the polymer-water particles with solids agglomerated thereon; and recovering a hydrocarbon oil bottoms portion having a reduced content of filterable solids.

2. The process of claim 1 wherein said treating is at a temperature of from 35° C. to 250° C. and for residence times ranging from 0.3 to 10 days.

3. The process of claim 1 wherein said solids are predominantly catalytic cracker fines having a diameter of less than 100 microns.

4. The process of claim 1 wherein said polyelectrolyte is a cationic polyacrylamide having a molecular weight of greater than one million.

5. The process of claim 1 wherein said solids are retorted oil shale fines.

6. A process as defined in claim 1 wherein the suspended particles have a diameter in the range of 0.5 to 50 microns.

* * * * *